United States Patent [19]

Wirsch

[11] 4,279,300

[45] Jul. 21, 1981

[54] TREATING FLUID APPLICATOR

[75] Inventor: Michael J. Wirsch, Odessa, Tex.

[73] Assignee: Exxon Production Research Company, Houston, Tex.

[21] Appl. No.: 115,596

[22] Filed: Jan. 25, 1980

[51] Int. Cl.[3] ..... E21B 19/00

[52] U.S. Cl. ..... 166/90; 175/84; 166/53; 134/151

[58] Field of Search ..... 166/244 C, 90, 77, 53; 175/8 A; 134/151; 118/315

[56] References Cited

U.S. PATENT DOCUMENTS

| | | | |
|---|---|---|---|
| 2,289,967 | 7/1942 | Johnson et al. | 134/51 UX |
| 3,378,088 | 4/1968 | Grant et al. | 175/84 |
| 3,475,781 | 11/1969 | Grant | 175/84 |
| 3,941,997 | 3/1976 | Davis | 134/151 X |

*Primary Examiner*—William F. Pate, III

*Attorney, Agent, or Firm*—John S. Schneider

[57] ABSTRACT

An applicator for applying chemical treating fluid to equipment, such as pump-sucker rod equipment, being run into a well includes a housing capable of being mounted on a wellhead and having an opening to permit passage of the equipment therethrough. A series of circumferentially spaced apart nozzles are arranged in the housing for directing flow of the chemical radially onto said equipment. Valve means are provided for controlling the flow of the chemical to the nozzles. A movable actuator which operates the valve means has a first position at which flow of the chemical through the valve is prevented and a second position at which flow of the chemical through the valve is permitted. The actuator includes spring means for urging the actuator to the first position thereof and means supported on the housing, which is responsive to the weight of the suspended equipment in the well to move the actuator to the second position thereof.

6 Claims, 6 Drawing Figures

TREATING FLUID APPLICATOR

BACKGROUND OF THE INVENTION

The invention concerns apparatus for automatically applying treating fluids to equipment being run into a well. More particularly, the invention concerns an applicator for use in coating downhole pumps and sucker rods with a chemical, such as a corrosion inhibitor, as that equipment is run into a well.

Methods currently employed to provide a corrosion inhibitor film to sucker rods and the external surfaces of downhole pumps used in the conventional downhole pump-sucker rod-pump jack method of artificial lift, such as pre-coating the equipment at the factory or at the equipment inspection point, or by injecting corrosion resisting chemical down well tubing while running the pumping equipment into the well, are not effective in flowing wells or in wells where the fluid level is above the pump, or in wells in which no attempt is made to introduce the chemical inhibitor when running the pumping equipment into the well.

The applicator of the present invention overcomes the disadvantages of prior art practices and provides an effective means for furnishing a corrosion inhibitor film or other chemical spray to equipment being lowered into a well.

SUMMARY OF THE INVENTION

According to the invention, there is provided apparatus for applying treating fluid to equipment being run into a well which comprises a housing capable of being mounted on a wellhead and having openings at each end to permit passage of the equipment therethrough. Nozzles are spaced circumferentially about the housing capable of directing flow of treating fluid radially toward the center of the housing through which the equipment passes. Valve means control flow of the treating fluid from a treating fluid supply through the nozzles and a weight responsive actuator operates the valve means. When in one position the actuator operates the valve means to prevent the flow of treating fluid from the nozzles and when in another position operates the valve means to permit the flow of treating fluid from the nozzles. The actuator includes spring means for urging the actuator to the one position thereof, the weight of the equipment being run into the well causing the actuator to move to the other position thereof against the bias of the spring means.

DESCRIPTION OF THE PREFERRED EMBODIMENTS

Figure 1:
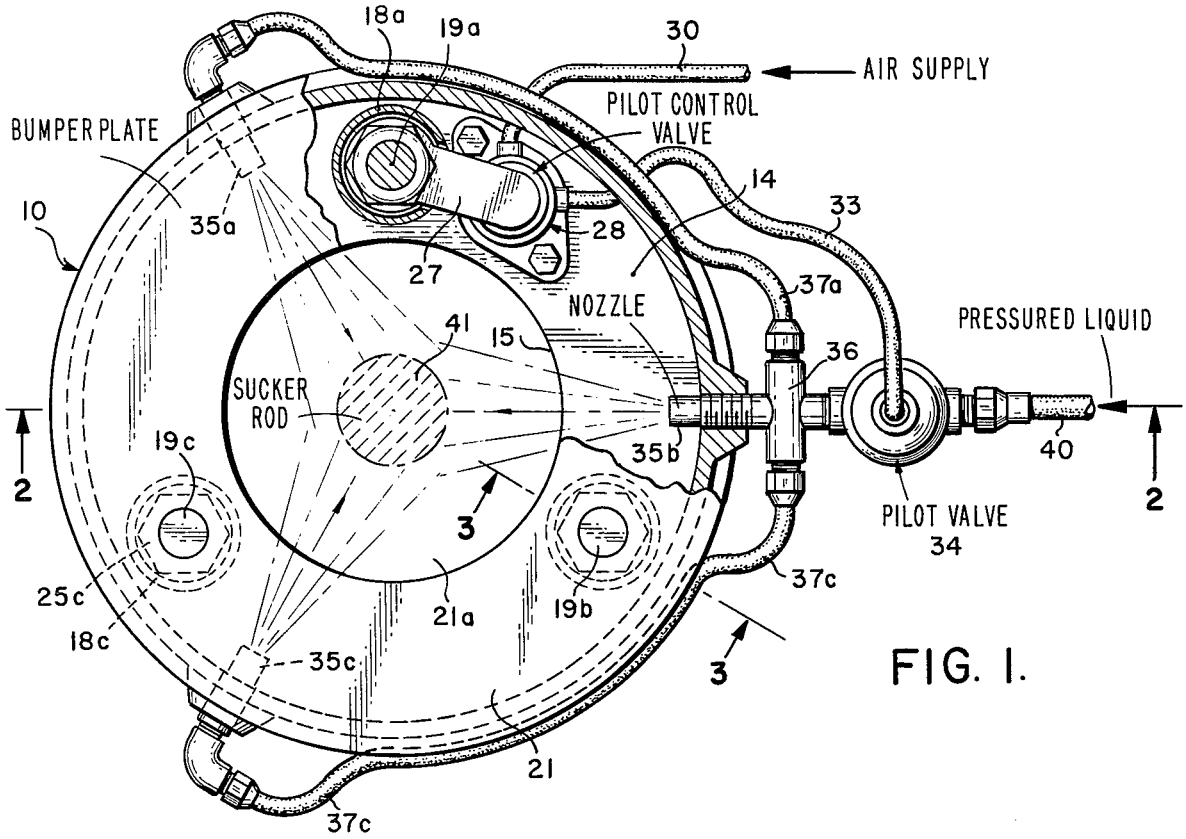
FIG. 1 is a plan view of the housing and associated valves, nozzles, control valves and other components of the applicator.
Figure 2:
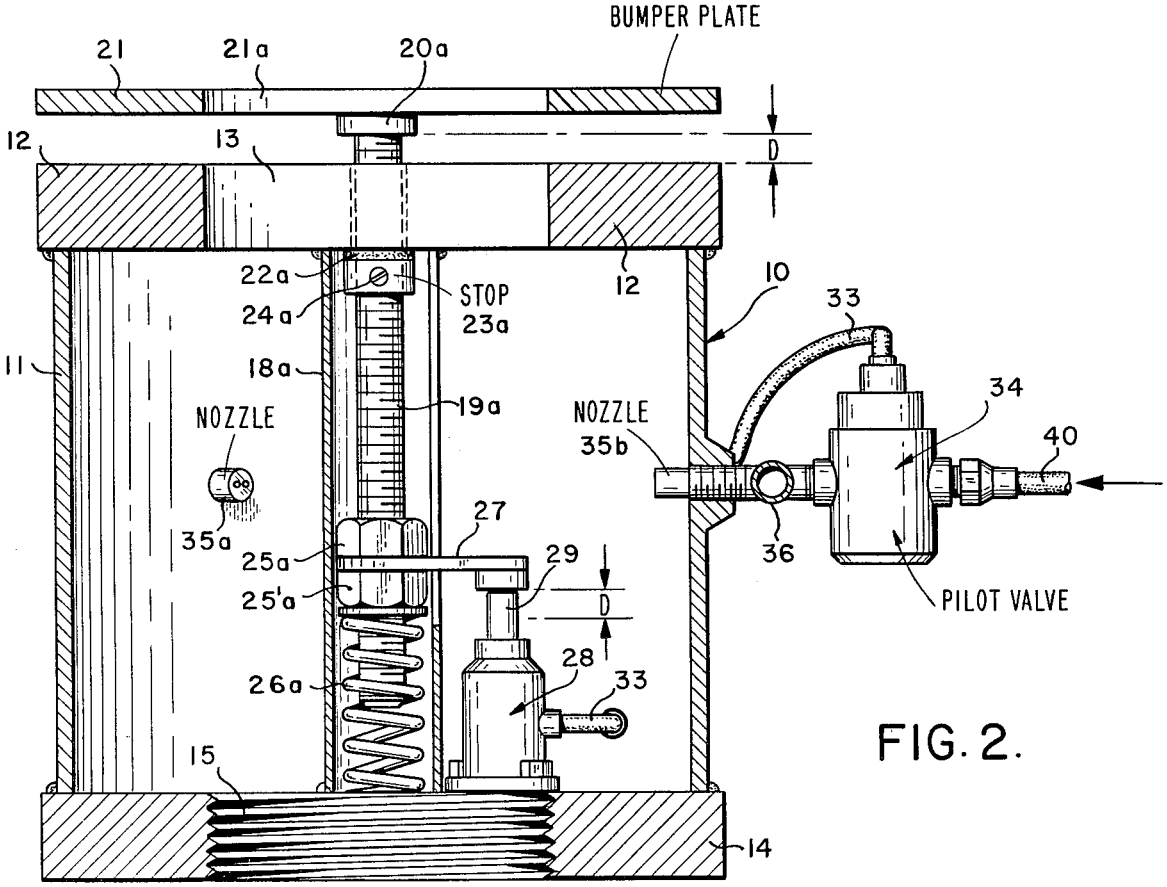
FIG. 2 is a view taken along line 2—2 of FIG. 1.

The main components of the applicator are shown in FIGS. 1–4. Those components include a housing 10 having a cylindrical side wall 11 and a top 12 provided with an opening 13 through the center thereof and a bottom 14 having a threaded opening 15 therethrough aligned with opening 13. Within housing 10 are three circumferentially spaced apart spring retaining tubes 18*a, b,* and *c*. In each tube there is located a screw threaded member 19*a*, 19*b*, and 19*c*, respectively which extends through an opening in the top 12 of housing 10 and terminates in a cap 20*a*, 20*b*, and 20*c*, respectively. A circular steel bumper plate 21 having a central opening 21*a* concentric to the opening 13 is mounted on caps 20*a*, 20*b* and 20*c*. Arranged on each screw threaded member 19*a*, 19*b*, and 19*c* adjacent the underside of top 12 is a rubber ring or cushion 22*a*, 22*b* and 22*c* located on a stop 23*a*, 23*b* and 23*c*, threaded on a member 19*a*, 19*b* and 19*c* and locked to that member by a set screw 24*a*, 24*b* and 24*c*, respectively. Two nuts 25*a*, 25*a'*, 25*b*, 25*b'* and 25*c*, 25*c'* are also threaded on each member 19*a*, 19*b* and 19*c*, respectively. A spring 26*a*, 26*b* and 26*c* engages the underside of the nuts 25'*a*, 25'*b* and 25'*c*, respectively to bias each member 19*a*, 19*b* and 19*c* and caps 20*a*, 20*b* and 20*c*, respectively and bumper plate 21 upwardly to the positions illustrated in FIGS. 2 and 3. A portion of tube 18*a* is cut-away to accommodate one end of an arm 27 which is secured on threaded member 19*a* between nuts 25*a* and 25'*a*. The other end of arm 27 engages a three-way, two position air controller valve 28. This valve includes a spring biased plunger 29 which reciprocates in the valve housing to which is connected one end of an air hose 30. The other end of hose 30 is connected to an air supply conduit 31 through an air pressure regulator 32. Another air hose 33 connects valve 28 to a pilot valve 34.

Three nozzles 35*a, b* and *c* extend through the wall 11 of housing 10 each preferably spaced apart 120° as shown. Nozzle 35*b* is connected to pilot valve 34 by way of a manifold 36 which is also connected to nozzles 35*a* and 35*c* through hoses 37*a* and 37*c*, respectively. A hose or line 40 is connected to pilot valve 34 for supplying pressurized corrosion inhibitor or other chemical liquid to valve 34 and then to nozzles 35 for the purpose of spraying the equipment, indicated by the sucker rod 41, being lowered into the well.

Figure 5:
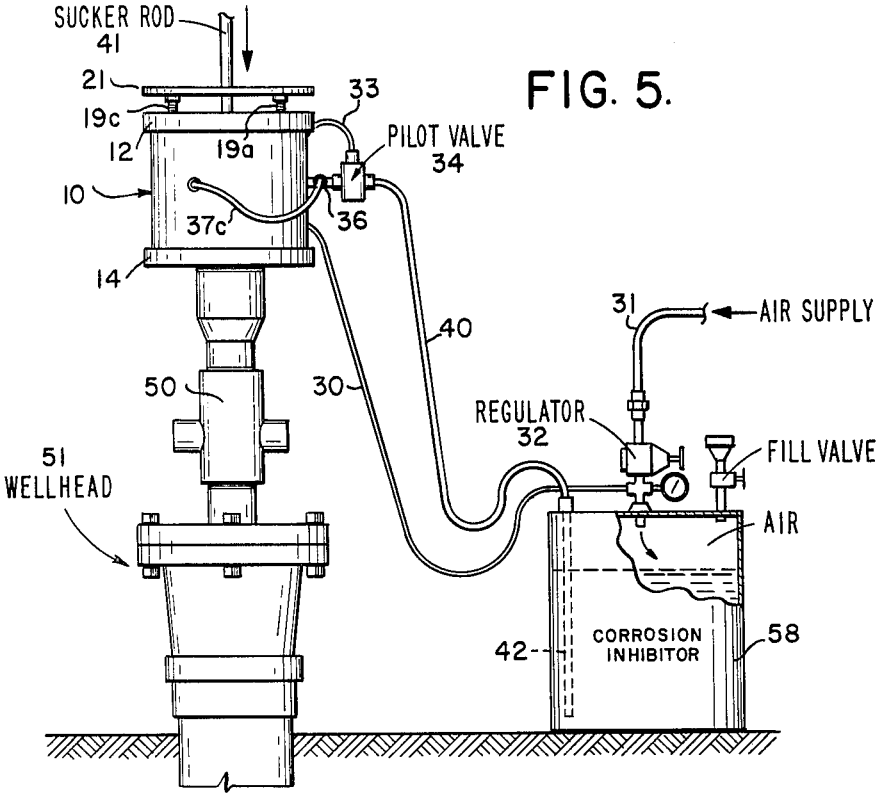
FIG. 5 is an elevational view of the applicator in operational position on a wellhead.

As shown in FIG. 5 housing 10 is connected to a stuffing box tee 50 mounted on a wellhead 51. Air supply conduit 31 is connected through regulator 32 into the upper end of a supply or reservoir tank 58 containing corrosion inhibitor or other chemical. Hose or conduit 40 is connected to a pipe 42 extending into the liquid in reservoir 58.

Figure 6:
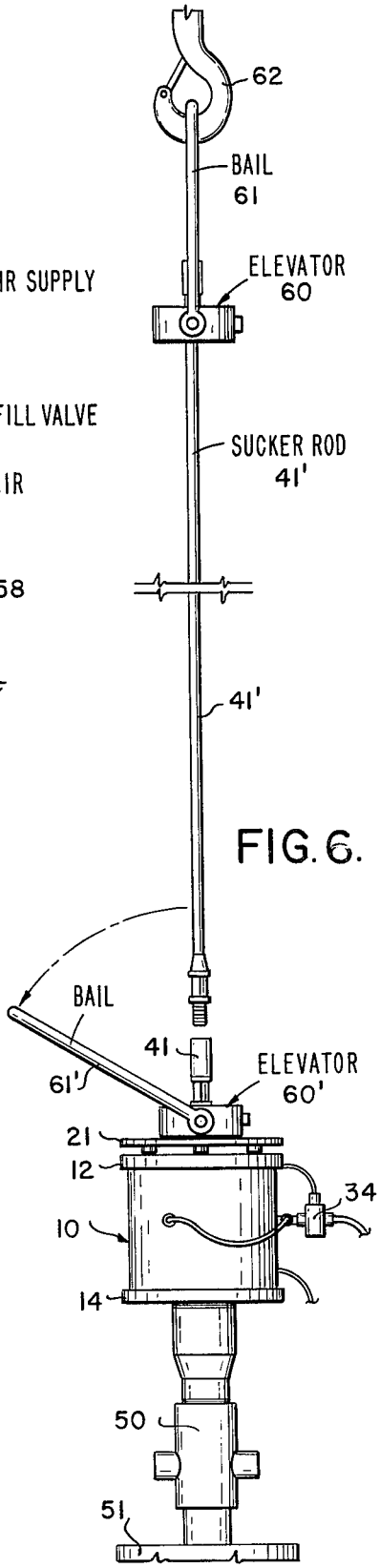
FIG. 6 is an elevational view of a portion of the applicator during sucker rod connecting operations.
Figure 3:
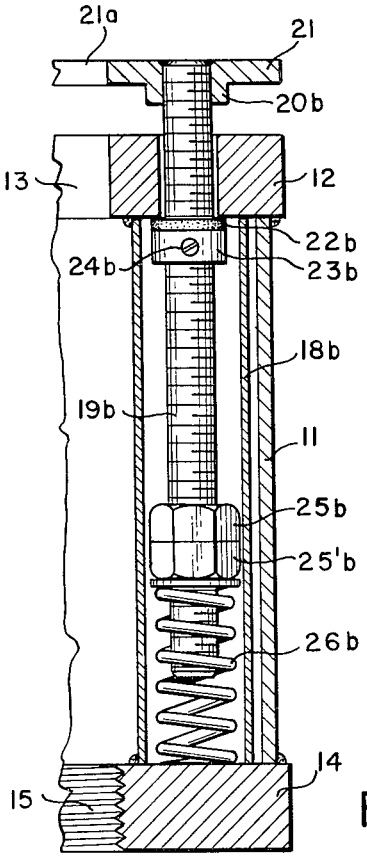
FIG. 3 is a view taken along line 3—3 of FIG. 1.
Figure 4:
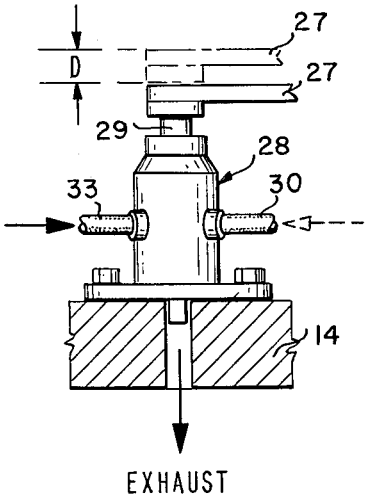
FIG. 4 is an elevational view of the pilot control valve.

As seen in FIG. 6, a sucker rod 41' is supported by an elevator 60 attached to a bail 61 which is suspended on a rotary hook 62. The upper end of another sucker rod 41 is supported by another elevator 60' to which is attached another bail 61' which has been moved to the left as indicated by the arrow to permit sucker rod 41' to be screwed into sucker rod 41. The weight of sucker rod 41 and other sucker rods and downhole equipment, such as pumps attached to it in the well, force bumper plate 21 down a distance D (see FIGS. 2 and 4) which in turn actuates pilot control valve 28 and bleeds air pressure from line 33 to allow pilot valve 34 to close to prevent pressurized liquid from flowing through hoses 37*a*, 37*b* and 37*c* and nozzles 35*a*, 35*b* and 35*c*. Sucker rod 41' is then threaded into the upper end of sucker rod 41. Elevator 60' and bail 61' are removed from sucker rod 41 to suspend the sucker rods and the downhole pumps from rotary hook 62. Weight of the downhole equipment is then removed from bumper plate 21 which permits it to move upwardly to its initial position by the action of springs 26*a*, 26*b* and 26*c* and allow actuation of pilot control valve 28 to supply air pressure to pilot valve 34 which opens that valve and permits pressurized fluid to flow through hoses 37*a*, 37*b* and 37*c* to nozzles 35*a*, 35*b* and 35*c* to cause fluid to be sprayed onto sucker rod 41' as it is run into the well.

Although operation of the applicator has been described with respect to pumps and sucker rods, it is also applicable to the running of other equipment, such as pipes, into the well. Also, liquids and chemicals other than corrosion inhibitors may be applied. Further, valve arrangements are contemplated by this invention other than the air pressure valve system described; for example, the valve actuator might operate a switch for control of an electric pump for pumping fluid to the nozzles. Further, the applicator valves may be employed in any desired configuration and more or less than three nozzles may be used. In addition, while the applicator as described herein is for spraying equipment being run into a well, the applicator may also be used to coat (or wash) equipment being removed from a well. The applicator functions in the same manner whether equipment is being run into or being withdrawn from a well; that is, fluid spray from the nozzles is cut off when the weight of the downhole equipment is supported on bumper plate 21 during disconnection of the equipment and fluid spray from the nozzles is applied to the equipment when it is suspended from the rotary hook and released from bumper plate 21. Other variations of the applicator may be made without departing from the spirit of the invention.

I claim:

1. Apparatus for applying fluid to equipment being run into a well comprising:

a housing capable of being mounted on a wellhead having an opening therethrough to permit passage of said equipment;

at least one nozzle in said housing capable of directing flow of said fluid toward said equipment;

valve means for controlling flow of said fluid to said nozzle;

a movable actuator for operating said valve means and having a first position at which flow of fluid through said valve means is prevented and a second position at which flow of fluid through said valve means is permitted;

said actuator including spring means for urging said actuator to the first position thereof and a movable plate supported on said housing, the weight of said suspended equipment in said well moving said actuator to the second position thereof.

2. Apparatus for applying liquid corrosion inhibitor to downhole pumps and sucker rods being run into a well comprising:

a housing capable of being mounted on a wellhead having an opening therethrough to permit passage of said pumps and sucker rods;

nozzles spaced circumferentially about the interior of said housing capable of directing flow of corrosion inhibitor radially toward the center of said opening;

a reservoir of corrosion inhibitor;

valve means for controlling flow of corrosion inhibitor to said nozzles;

an actuator for operating said valve means having a first position at which flow of corrosion inhibitor is prevented and a second position at which said flow of corrosion inhibitor is permitted;

spring means for urging said actuator to the first position thereof;

the weight of said suspended pumps and sucker rods on said actuator causing said actuator to move to the second position thereof.

3. Apparatus as recited in claims 1 or 2 in which three nozzles are arranged circumferentially and equidistantally within said housing.

4. Apparatus as recited in claims 2 and 3 in which said valve means includes an air pressure operated first valve for controlling flow of said corrosion inhibitor to said nozzles and a weight responsive second valve controlled by said actuator for operating said first valve.

5. Apparatus as recited in claim 4 in which said actuator includes a bumper plate arranged on said housing.

6. Apparatus as recited in claim 5 in which said actuator includes screw threaded members mounted on said spring means, said bumper plate being mounted on said screw threaded members, stop means connected to each of said screw threaded members for limiting movement of said screw threaded members, and an arm connected to one of said screw threaded members, said arm engaging said first valve.

* * * * *